US009747781B2

(12) United States Patent
Whitney et al.

(10) Patent No.: US 9,747,781 B2
(45) Date of Patent: Aug. 29, 2017

(54) SHOE-BASED WEARABLE INTERACTION SYSTEM

(71) Applicant: Intel Corporation, Santa Clara, CA (US)

(72) Inventors: Kofi Whitney, Hilsboro, OR (US); Joseph A. Cianfrone, San Jose, CA (US); Rohit Banerjee, Chester Springs, PA (US); Glen J. Anderson, Beaverton, OR (US)

(73) Assignee: Intel Corporation, Santa Clara, CA (US)

( * ) Notice: Subject to any disclaimer, the term of this patent is extended or adjusted under 35 U.S.C. 154(b) by 90 days.

(21) Appl. No.: 14/498,344

(22) Filed: Sep. 26, 2014

(65) Prior Publication Data

US 2016/0093199 A1 Mar. 31, 2016

(51) Int. Cl.
*G08B 25/10* (2006.01)
*A43B 3/00* (2006.01)

(52) U.S. Cl.
CPC ..... *G08B 25/10* (2013.01); *A43B 3/0005* (2013.01)

(58) Field of Classification Search
CPC ..... G06F 1/163; G06F 1/1694; G06F 3/017; G06F 3/0346; A43B 3/0005; A43B 1/0054; G08B 25/10; A63B 2225/50; A63B 2220/40; A63B 24/0062
See application file for complete search history.

(56) References Cited

U.S. PATENT DOCUMENTS

2003/0163287 A1* 8/2003 Vock ..... A43B 3/0005 702/187
2005/0016027 A1* 1/2005 Trinkaus ..... A43B 3/0005 36/115
2006/0003839 A1* 1/2006 Lawrence ..... G06F 3/0334 463/36
2006/0143645 A1* 6/2006 Vock ..... A43B 3/00 725/9
2009/0107009 A1* 4/2009 Bishop ..... A43B 1/0027 36/114
2009/0113762 A1* 5/2009 Leimer ..... A43B 3/0005 36/114
2010/0076692 A1* 3/2010 Vock ..... A43B 3/0005 702/19
2010/0146822 A1* 6/2010 MacGregor ..... A43B 5/12 36/136
2010/0184563 A1* 7/2010 Molyneux ..... A43B 1/0054 482/1
2010/0184564 A1* 7/2010 Molyneux ..... A43B 1/0054 482/1
2010/0201491 A1* 8/2010 Jacot ..... A43B 3/0005 340/10.1
2011/0170311 A1* 7/2011 Reuben ..... A43B 1/0036 362/554

(Continued)

*Primary Examiner* — Orlando Bousono
(74) *Attorney, Agent, or Firm* — Schwegman Lundberg & Woessner, P.A.

(57) ABSTRACT

A system and method of initiating a command in a computing system having a processor. A pair of wearable items are detected as being in close proximity and a command interface connected to the processor is activated on detecting that the pair of wearable items are in close proximity. A command is received via the command interface and the command is transferred to the processor.

20 Claims, 9 Drawing Sheets

(56) References Cited

U.S. PATENT DOCUMENTS

| | | | | |
|---|---|---|---|---|
| 2011/0199393 | A1* | 8/2011 | Nurse | A43B 3/00 345/665 |
| 2011/0304497 | A1* | 12/2011 | Molyneux | A43B 1/0054 342/42 |
| 2012/0262329 | A1* | 10/2012 | Molyneux | A43B 1/0054 342/42 |
| 2014/0135954 | A1* | 5/2014 | Vranish | A43B 3/0005 700/91 |
| 2014/0266570 | A1* | 9/2014 | Sharma | G09B 21/003 340/4.12 |
| 2014/0266571 | A1* | 9/2014 | Sharma | G09B 21/003 340/4.12 |
| 2015/0092520 | A1* | 4/2015 | Robison | G04G 21/02 368/9 |
| 2015/0145653 | A1* | 5/2015 | Katingari | G06F 1/163 340/12.3 |
| 2015/0326985 | A1* | 11/2015 | Priyantha | H04R 29/004 381/56 |

* cited by examiner

SHOE-BASED WEARABLE INTERACTION SYSTEM

BACKGROUND ART

Shoes equipped with sensors are increasingly common. They are used to track athletic activities such as running, to track the elderly, for navigation and to help the vision-impaired to move through their environment. Some such shoes include a processor used to communicate with other devices.

BRIEF DESCRIPTION OF THE DRAWINGS

Embodiments are illustrated by way of example, and not by way of limitation, in the figures of the accompanying drawings in which like reference numerals refer to similar elements.

DESCRIPTION OF THE EMBODIMENTS

In the following detailed description of example embodiments of the invention, reference is made to specific examples by way of drawings and illustrations. These examples are described in sufficient detail to enable those skilled in the art to practice the invention, and serve to illustrate how the invention may be applied to various purposes or embodiments. Other embodiments of the invention exist and are within the scope of the invention, and logical, mechanical, electrical, and other changes may be made without departing from the subject or scope of the present invention. Features or limitations of various embodiments of the invention described herein, however essential to the example embodiments in which they are incorporated, do not limit the invention as a whole, and any reference to the invention, its elements, operation, and application do not limit the invention as a whole but serve only to define these example embodiments. The following detailed description does not, therefore, limit the scope of the invention, which is defined only by the appended claims.

Smart shoe designs have yet to live up to the wearable computing tenets of hands-free, low-attention interfaces. Current designs rely on awkward, on-shoe controls (e.g., ill-placed displays and hardware buttons) and/or remote controls (e.g., a tethered cellphone). Smart shoe interfaces should better accommodate the wearer by supporting multimodal interaction that is better situated in the wearer's context (e.g., on-the-go interaction).

Figure 1:
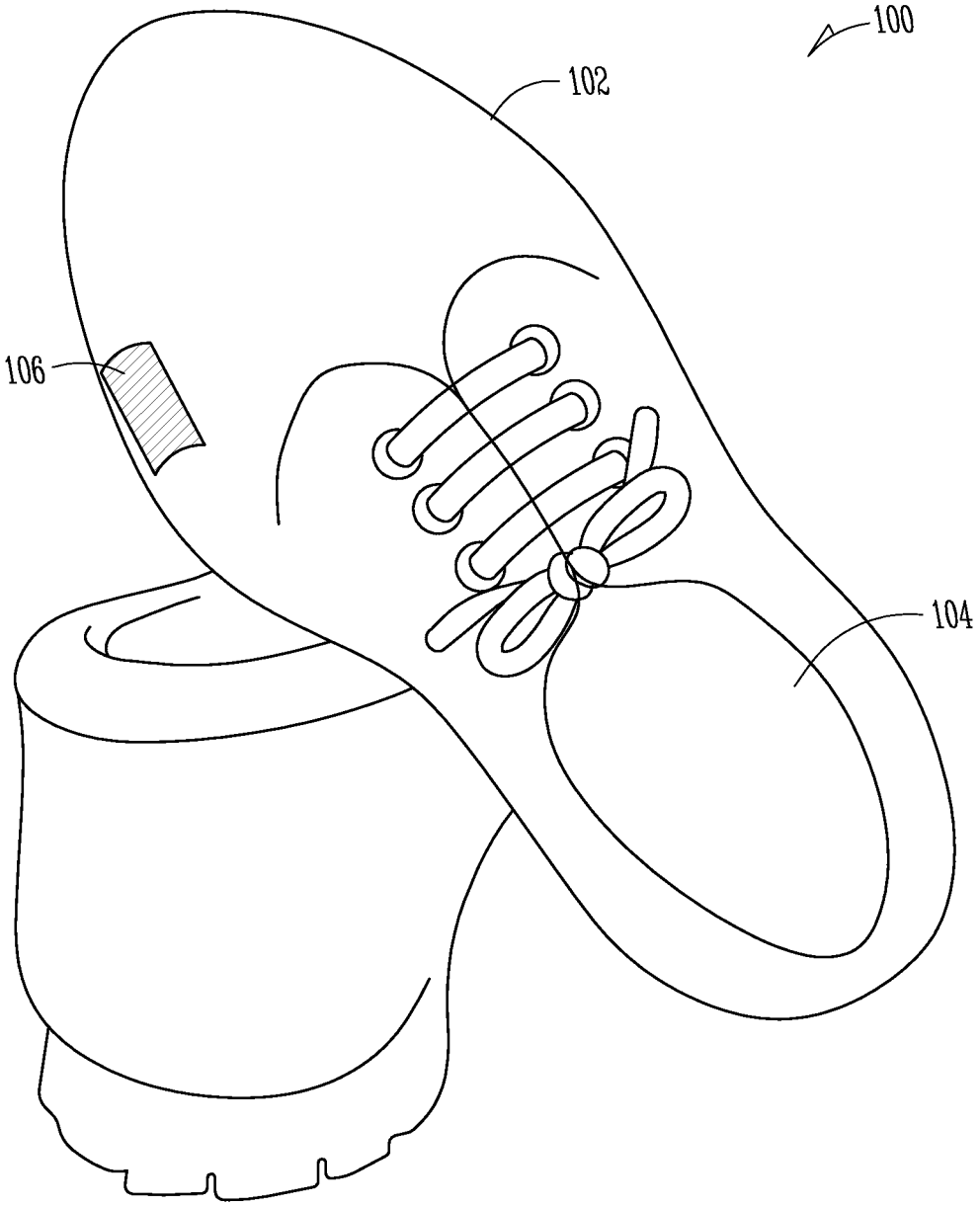
FIG. 1 illustrates a wearable user interface according to one aspect of the present invention.

A wearable user interface that addresses these concerns is shown in FIG. 1. In the example shown in FIG. 1, smart shoe system 100 includes a shoe 102, a processor 104 embedded in the shoe 102 and a shoe interface 106 connected to the processor 104. Processor 104 and shoe interface 106 interact to provide an interaction system for smart shoes that enables the waking & control of smart shoes. In some embodiments, the interaction is done using a low-power gesture recognition system that permits hand/eyes-free interaction. In some such embodiments interaction is through feet-based gestures. In some such embodiments, feedback is provided via haptic feedback. Other feedback mechanisms are contemplated as well, including voice, or a combination of voice and haptic feedback.

The approach described enables discreet, hands/eyes-free interaction with smart shoes. The wearer is not required to use a mobile device or an on-shoe interface to complete a task.

Figure 2:
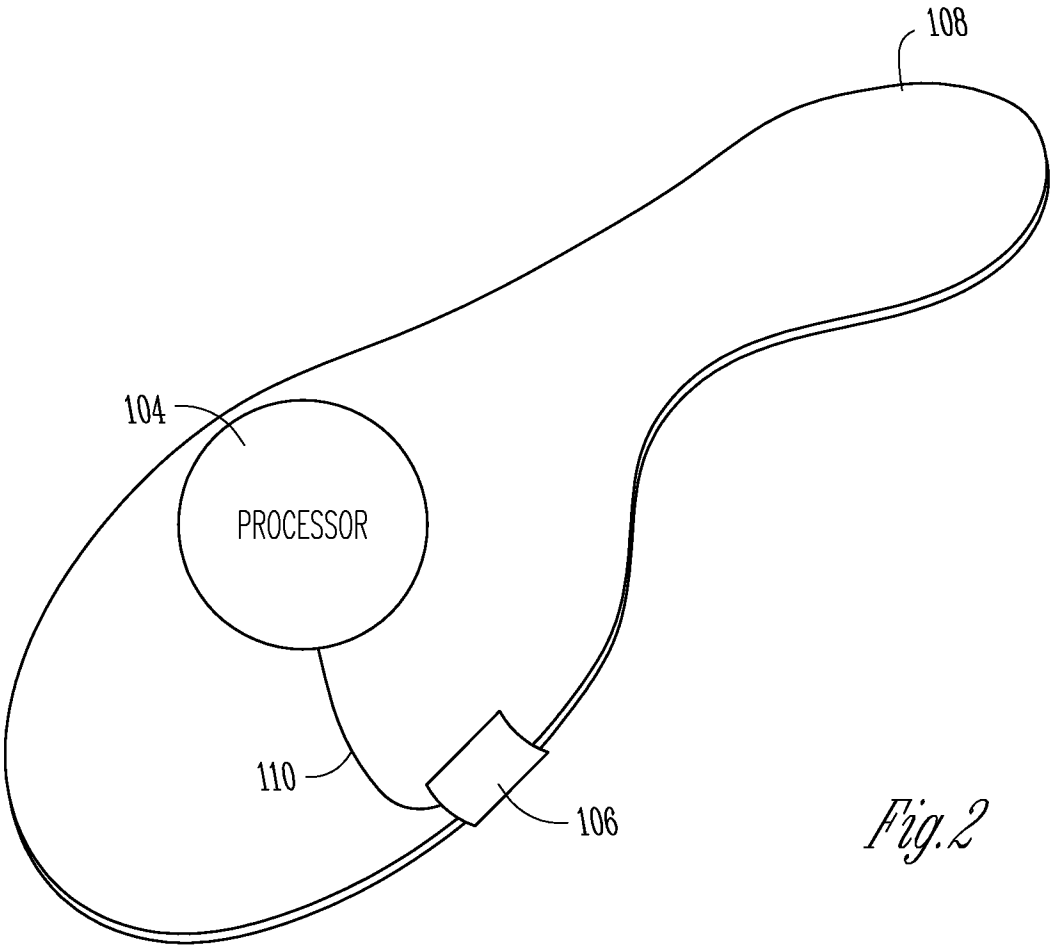
FIGS. 2 and 3 illustrate insoles that can be used to create a wearable user interface.

As noted above, in some embodiments, processor 104 and the required support circuitry is embedded into shoe 102. In other embodiments, processor 104 and the required support circuitry is embedded into an insole 108 that can be fitted to ordinary shoes. One example embodiment of an insole 108 that can be fitted into a shoe is shown in FIG. 2. In the example shown in FIG. 2, processor 104 is embedded into insole 108 and is connected through a connector 110 to shoe interface 106.

Figure 3:
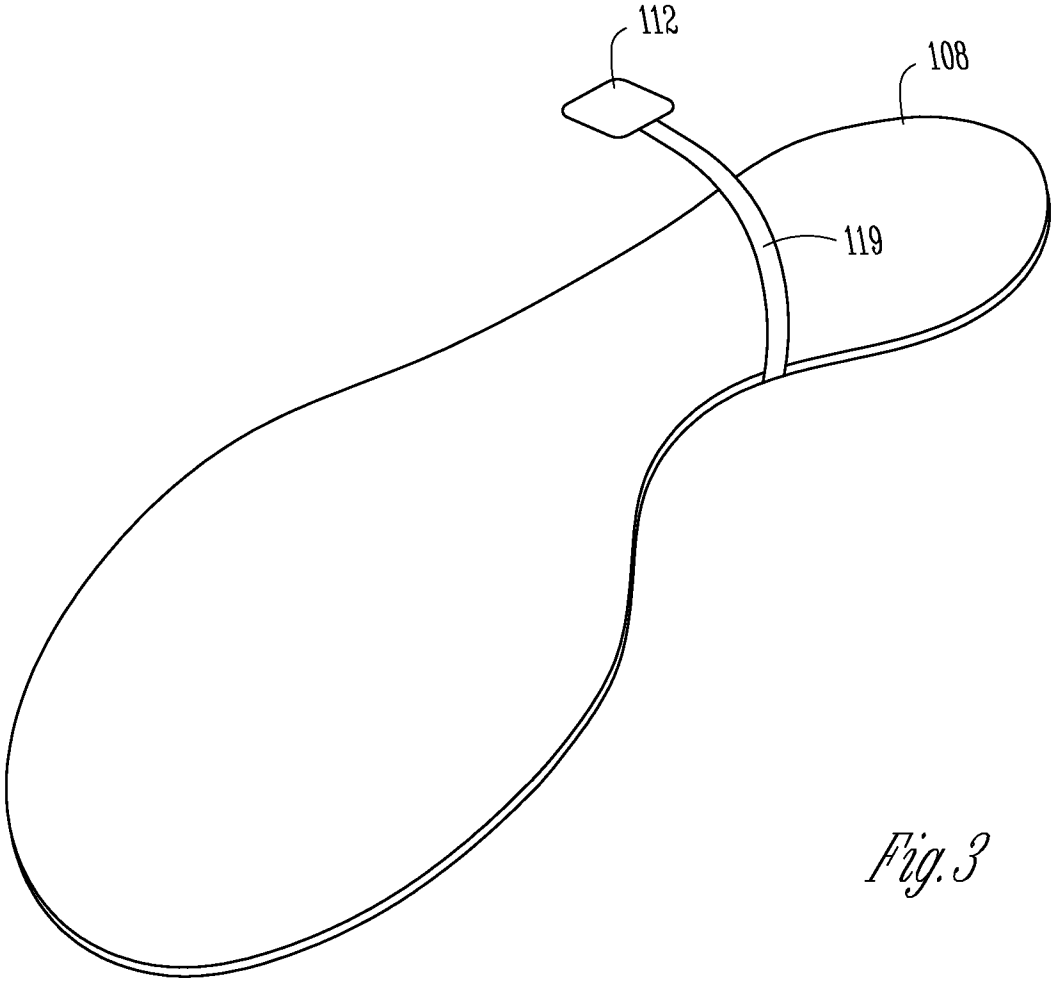

In one example embodiment, as is shown in FIG. 3, insole 108 includes a separate processor module 112. In some such embodiments, processor module 112 is connected through a cable 119 to insole 108. In some embodiments, processor module 112 includes processor 104 and the actuators, displays/LEDs, hardware buttons, interconnects for extensibility, radios, sensors, speakers and storage needed to implement the particular system 100.

In some embodiments, the interconnects for extensibility are connected to existing sensors and processors in a given smart wearable device in order to extend the capabilities of the device.

In some embodiments, cable 119 provides interconnects for power and input/output. In some such embodiments, cable 119 is designed to be comfortable, durable and with masked routing.

In some embodiments, insole 108 includes actuators, energy harvesting materials, interconnects for extensibility and sensors. In some such embodiments a processor embedded in insole 108 provides an interface to the sensors and actuators.

In some embodiments, processor module 112 is attached to the outside of the shoe (e.g., the shoelaces) and communicates with other sensors and components of system 100 wirelessly.

In some embodiments, processor module 112 is designed to fit within the form factor of the Nike+ sensor and is inserted in a void under the sock liner of Nike+ ready shoes.

Figure 4:
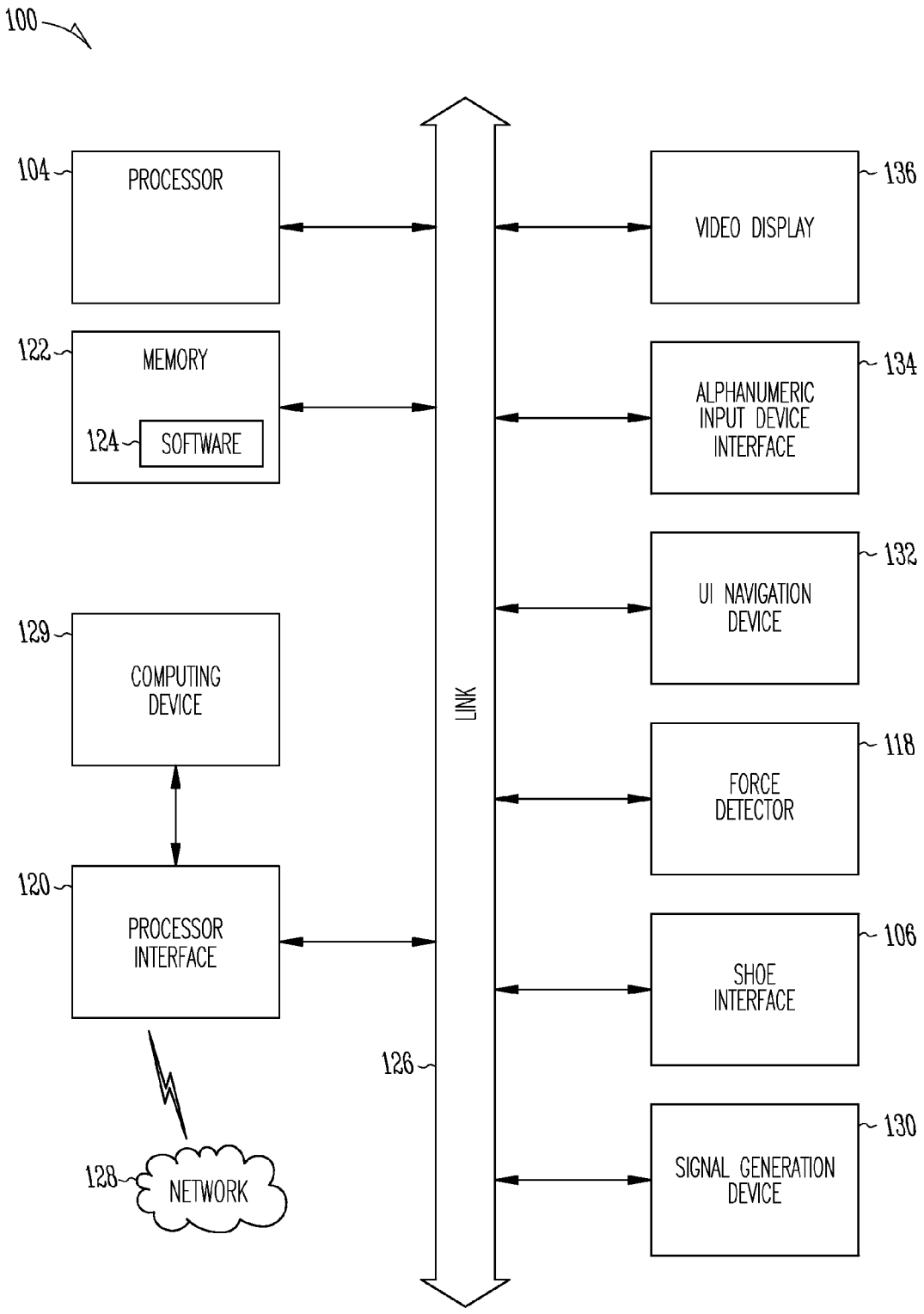
FIG. 4 illustrates another example embodiment of a wearable user interface according to one aspect of the present invention.

An example embodiment of smart shoe system 100 is shown in FIG. 4. In the embodiment shown in FIG. 4, processor 104 is connected to memory 120 and retrieves instructions from the software 124 stored in memory 122. Processor 104 is also connected through link 126 to processor interface 120 and to shoe interface 106. In some embodiments, processor 104 communicates to a network 128 such as the cloud via processor interface 120. In one such embodiment, processor 104 passes commands to devices on the cloud via the shoe command interface as described below.

In some embodiments, processor interface 120 is used to update software and firmware on processor 104. In other embodiments, processor 104 is connected to a rechargeable battery and processor interface 120 is used to charge the battery.

In some embodiments, processor interface 120 includes a mechanism such as near filed communication (NFC), or such as infrared (IR), Bluetooth or Wi-Fi.

In some embodiments, processor 104 communicates to a computing device 129 (such as a computer system or a smart phone) via interface 120. In one such embodiment, processor 104 passes commands to computing device 129 via the shoe command interface as described below.

In some embodiments, shoe system 100 includes a force detector 118 (e.g., an piezoelectric device). In some such embodiments, force detector 118 detects when a user places weight on the sole of shoe 102 and wakes processor 104. This approach is used to make sure that shoe system 100 is in the lowest power state when the shoe is not being worn. In some such embodiments, force detector 118 is used to detect nudge commands in system 100.

In some embodiments, processor 104 is connected to a signal generation device 130 through link 126. In one such embodiment, signal generation device 130 provides haptic feedback to the wearer of the shoe in response to foot gestures by the wearer. In other such embodiments, signal generation device 130 provides audible feedback (e.g., a sound, or a voice response) to the wearer of the shoe in response to foot gestures by the wearer.

In some embodiments, shoe system 100 includes a user interface navigation device 132. In one such embodiment, device 132 includes a sensor used to detect changes in a foot's position. In one such embodiment, the sensor detects motion in three-dimensions and the sensed motion is translated into cursor movements on a video display 136 or a device such as a smart phone by processor 104.

In some embodiments, device 132 includes accelerometers. In some such embodiments, accelerometers or gyros are used to detect gesture commands in system 100.

In some embodiments, device 132 includes a microphone. In some such embodiments, a microphone is used to detect voice commands in system 100.

In some embodiments, device 132 includes a touch sensor. In some such embodiments, touch sensors are used to detect touch or swipe commands in system 100.

In some embodiments, system 100 includes an alphanumeric input device interface 134 connected to processor 104. In some such embodiments, interface 134 is a Bluetooth interface.

In some embodiments, processor 104, when idle, is placed into a low-power state. In some such embodiments, processor 104 is awoken by placing shoe interface 106 into close proximity with a second shoe. In some embodiments, shoe interface 106 includes a camera that detects proximity to a second shoe. In some such embodiments, an indicator is placed on the second shoe so that it falls within the field of vision of the camera in interface 106 so as to ease recognition of the second shoe. In some embodiments, the shoes must be within approximately two inches of each other for system 100 to detect that the shoes are in close proximity.

Figure 5:
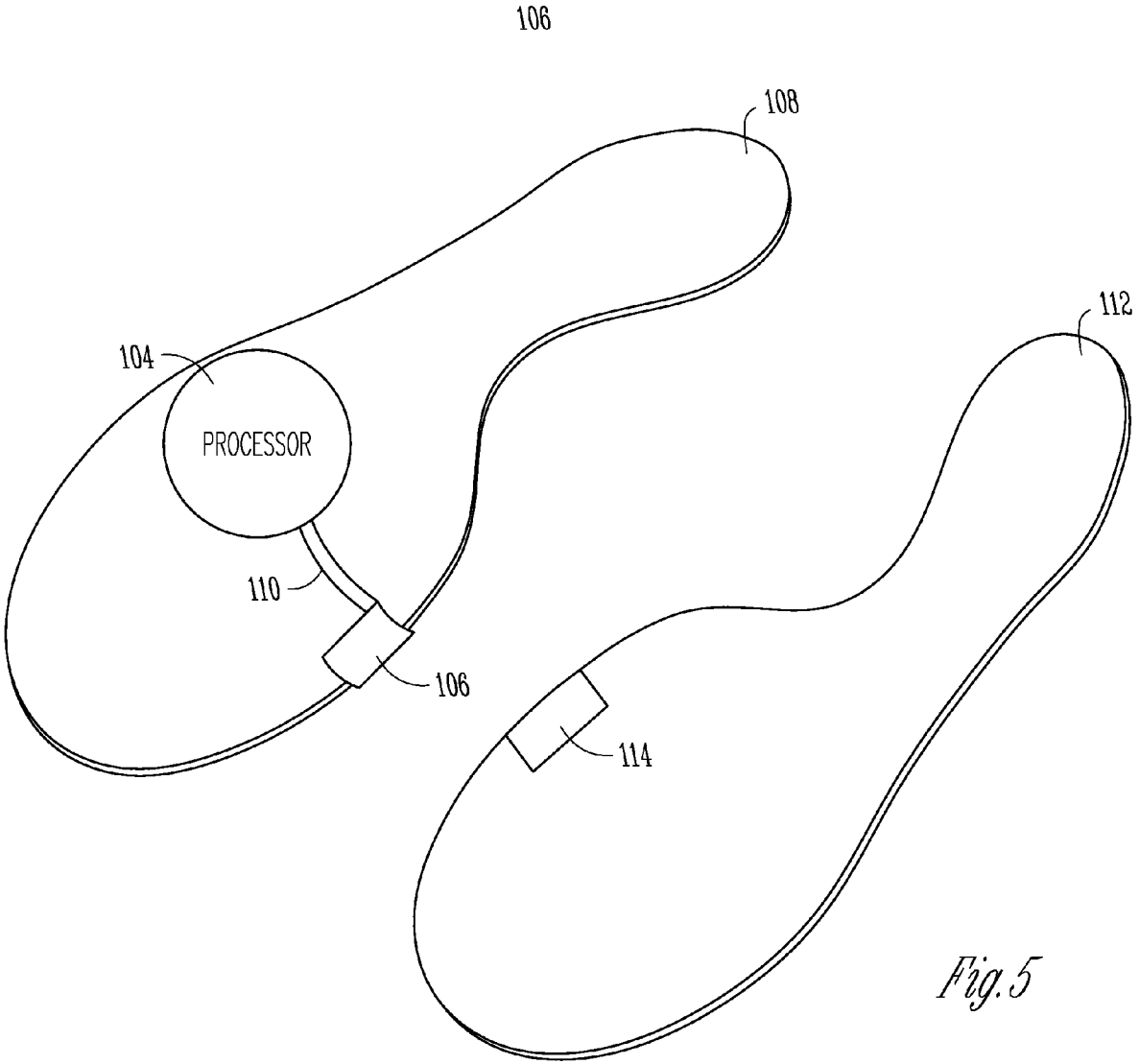
FIG. 5 illustrates a pair of insoles that can be used to create a wearable user interface.

In some embodiments, smart shoe system 100 includes a second shoe interface 114 that is installed into the second shoe. In some embodiments, the second shoe interface 114 is embedded into the second shoe. In other embodiments, shoe interface is installed in a second insole 112, such as shown in FIG. 5. In one such embodiment, processor 104, when idle, is placed into a low-power state and is awoken by placing shoe interface 106 into close proximity with shoe interface 114. In some embodiments, this is done by placing the two shoe interfaces 106, 114 in contact. In other embodiments, the two shoes do not have to touch. Instead communicative contact is made between the two shoe interfaces via a mechanism such as NFC, or through a mechanism such as IR, Bluetooth or Wi-Fi. In yet another embodiment shoe interface 106 includes a magnetic switch and a magnet installed in the second shoe triggers the switch to activate.

Figure 6:
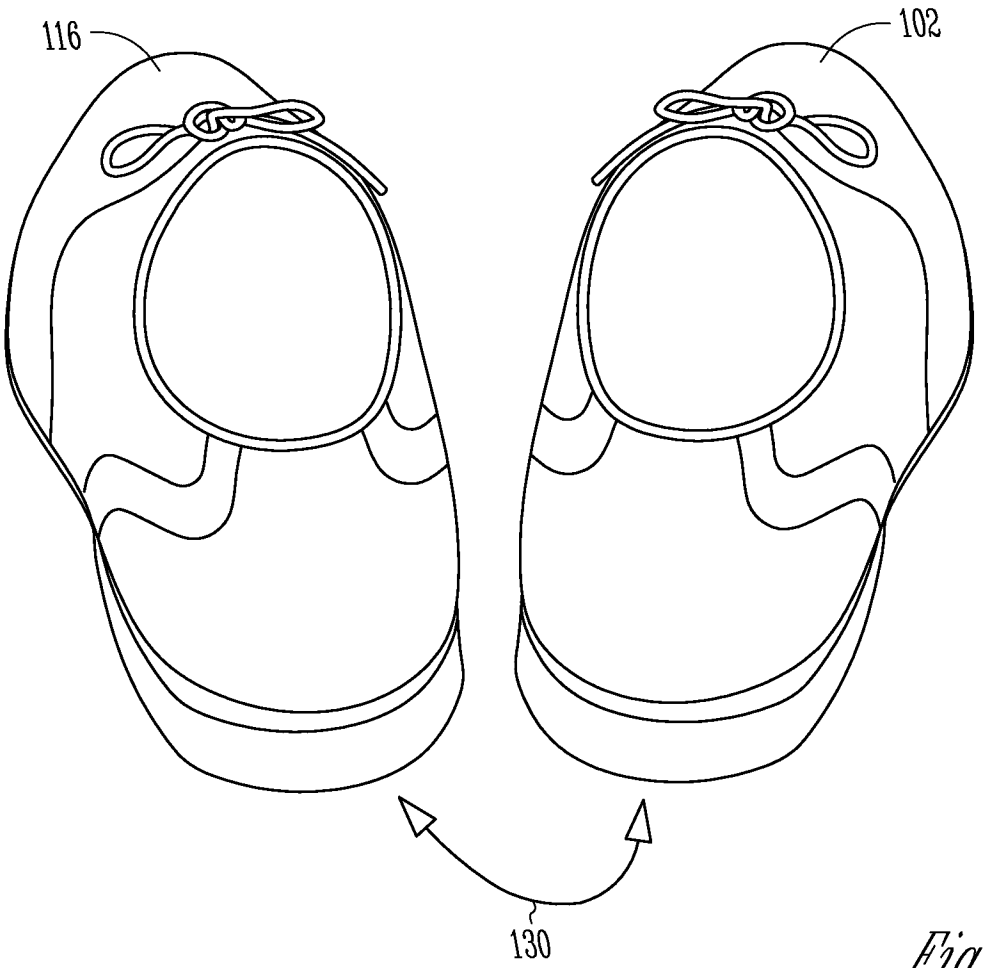
FIG. 6 illustrates another example embodiment of a wearable user interface according to one aspect of the present invention.

One example embodiment of an NFC-based system is shown in FIG. 6. In the example shown in FIG. 6, NFC chips (less than 15 mA power draw) are placed in the heel or the inner-facing outsole of smart shoes. When shoes 102 and 116 touch or are brought closely together, the NFC chips communicate as shown at 130 and initiate a function (e.g., wake from sleep mode, initiate Bluetooth pairing, activity monitoring, etc.). In other embodiments, low-power sensors based on light are used to determine the close proximity of smart shoes (e.g., IR sensors are efficient (in the μA range)).

As noted above, in some embodiments, processor 104 is kept in a low-power state when not in use and is awoken by bringing shoe 102 into close proximity to a companion shoe. In one such embodiment, movement of shoe 102 after processor 104 is awoken can be used as part of a gesture-based communication system. For instance, in some embodiments, movement of shoe 102 is used to provide mouse-like gestures on a pad or phone device. In other embodiments, once processor 104 is awoken, it begins to listen for input via a cell phone, or via voice or other command. In one such embodiment, once the system wakes, other sensors come online to detect commands from the wearer (e.g., voice or foot-based gestures).

Figure 7:
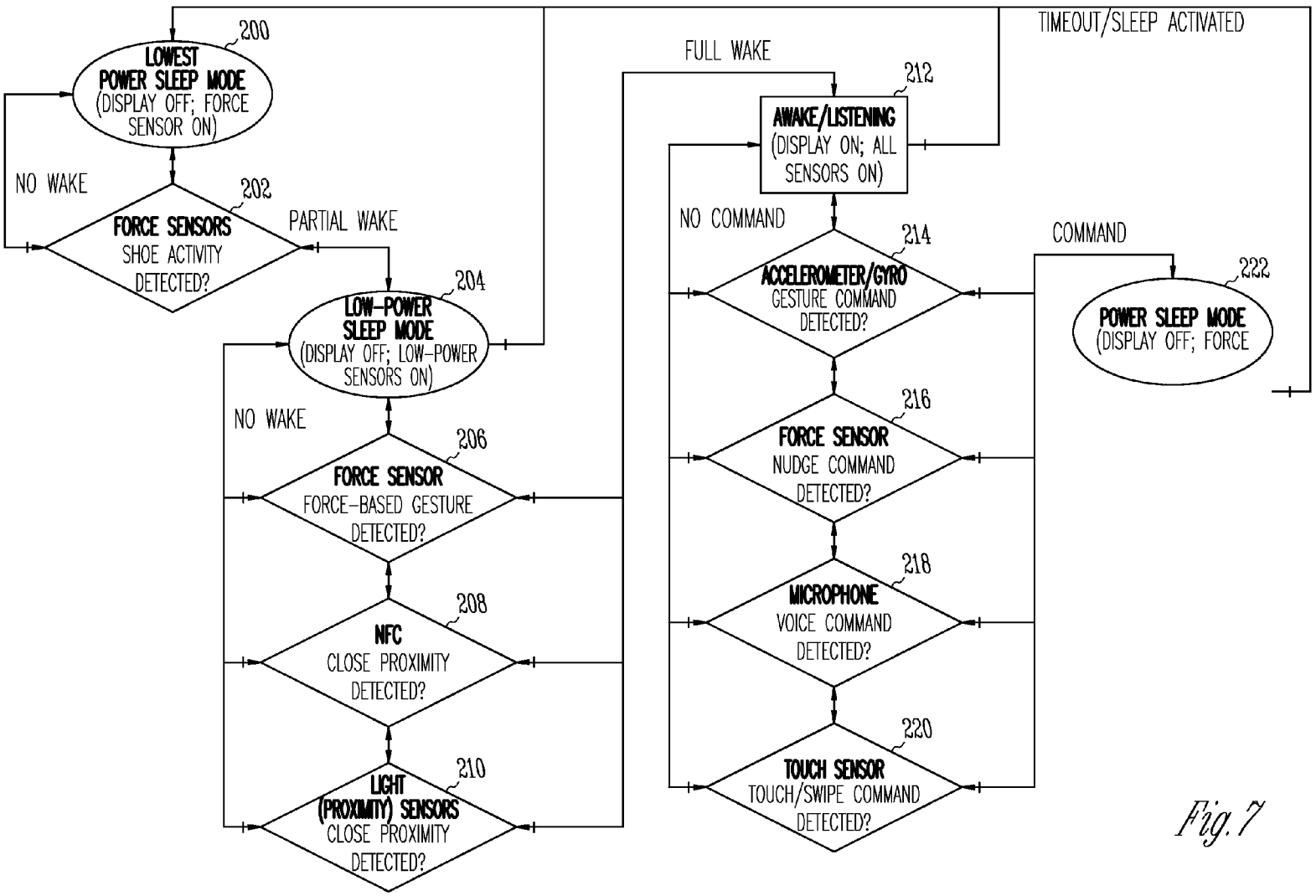
FIG. 7 illustrates a method of initiating a command.

An example embodiment of states entered by processor 104 in system 100 is shown in FIG. 7. At 200, processor 104 is in the lowest power mode. In the example shown in FIG. 7, any displays are off and only one or more force detectors 118 are active. A check is made at 202 to determine if a force was detected by force detector 118 (i.e., the shoe is being worn). If not, control moves back to 200. If, however, the check at 202 determines a force was detected, control moves to 204 and proximity sensors in shoe interface 106 are activated. Control then moves to 206 and a check is made at 206 to determine if a force is still being detected by device 132. If so, control moves to one or both of 208 and 210 and a check is made to see if close proximity to a second shoe is detected. If so, control moves to 212 and system 100 is in fully awake mode, with any displays active and all sensors active. (In the example shown in FIG. 7, close proximity can be detected by either the NFC circuit or the light sensor. In other embodiments, only one type of proximity detector is used in system 100).

If neither force from detector 118 nor close proximity from interface 106 is detected at 206-210, control moves back to 204 and the process repeats. If neither is detected within a given amount of time, control moves back to 200 and system 100 enters its lowest power mode.

At 212, system 100 is in fully awake mode and is responsive to all sensors. Control moves to determine if a gesture command is detected at 214, a nudge command is detected at 216, a voice command is detected at 218 or a touch/swipe command is received at 220. If so, control moves to 222 and the command is executed. Control then moves back to 200.

In one embodiment, a nudge command is entered by tapping the bottom of shoe 102 against the floor.

In one embodiment, system 100 monitors for the timing of the accelerometer events from the pair of wearables 102 to determine whether accelerometer events on the two occurred within a given time limit (and/or perhaps orientation, direction, force), thus implying a purposeful clicking together command, versus random accelerometer events.

If, however, no command is detected at any of 214, 216, 218, or 220, control moves back to 212, and the process repeats. If no commands are detected within a given amount of time, control moves back to 200 and system 100 enters its lowest power mode.

As noted above, the commands entered via the command interface described above are passed to processor 104. In some embodiments, they are forwarded to computing devices such as computing device 129 in FIG. 4. In other embodiments, they are forwarded to devices within the cloud via networks such as network 128 in FIG. 4.

In some embodiments, the amount of haptic feedback increases as the power becomes increasingly "awake." For instance, a simple buzz might accompany a move to state 204, while a more complex, and informative, response might be called for when, for instance, a command is recognized.

Some example applications will be described next. In one application, a runner joins shoes together. This activates an accelerometer in device 132 for a brief period. The runner then engages in a quad stretch activity. This gesture is easily recognized (rarely happens) and it triggers the fitness monitoring routines (e.g., increase sampling rate of sensors; start/change music, etc.). The wearer is better able to focus on their goals if such gestures are situated in their routine.

Figure 8:
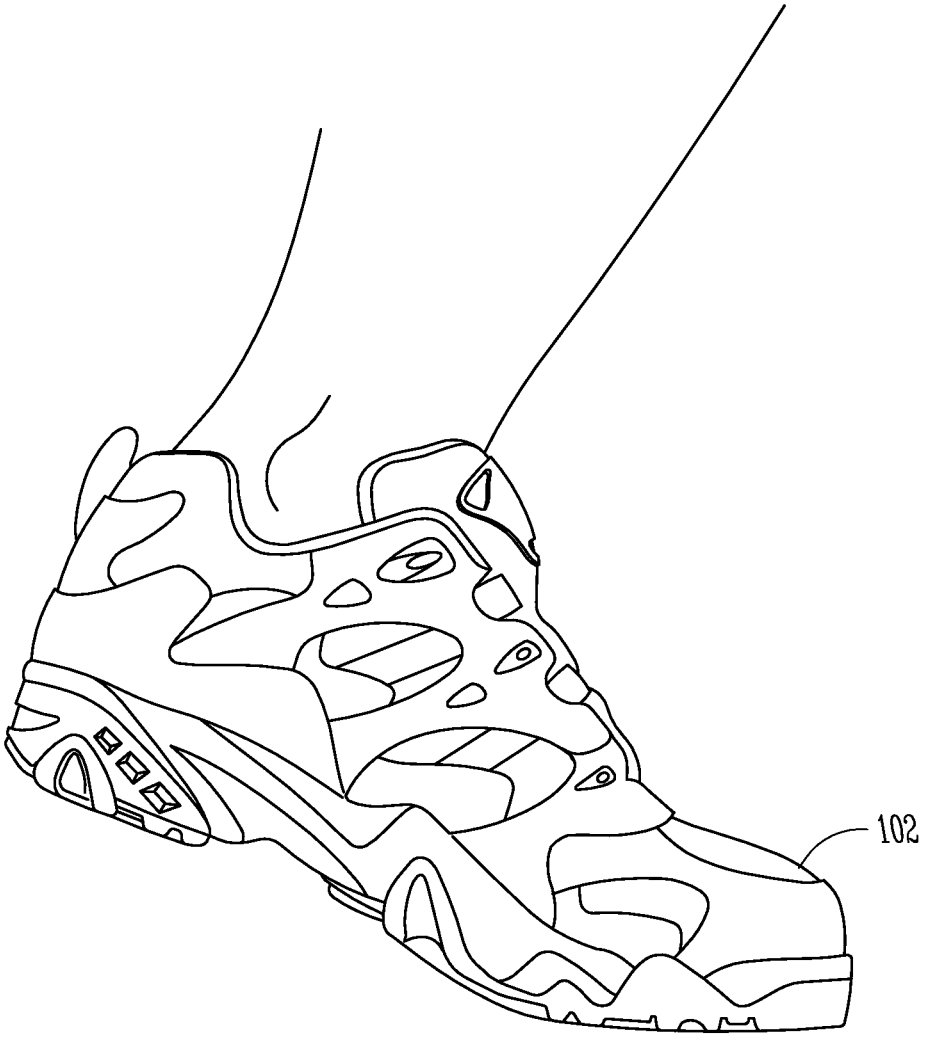
FIG. 8 illustrates a gesture-based interaction.

In another example application, as is shown in FIG. 8, when arriving at a restaurant, you decide you want to check-in and inform your party. Rather than pullout your phone, you join your feet together (wakes shoes), then you gently swipe a check with shoe 102 on your right foot (accelerometer). If you decide not to use a foot-based gesture, you may execute a voice command by saying "check-in".

In another example application, a party of people wearing shoes 102 place their shoes in close proximity in order to join a party, exchange contacts, or otherwise communicate (using, e.g., NFC).

In yet another example embodiment, shoes 102 can be used with a gaming system to provide input to the gaming system.

In one embodiment, system 100 is implemented in a pair of gloves. In another embodiment, system 100 is implemented in a pair of wrist bands. In some embodiments combinations of shoes, gloves, jewelry, watches, wrist bands and head bands implement system 100. For example, in one embodiment, a watch interacts with a ring to implement system 100. Other combinations of wearable items can be used as well. In one embodiment, one or more accelerometers in one of the wearable items detect movement and awaken processor 104 in that item. Processor 104 then begins to look to see if the pair of wearable items is in close proximity before accepting commands as described above.

The above described systems and methods provide extremely low power (power is only used when interaction is initiated by the user), and discrete, hands/eyes-free interaction with the wearable devices. Furthermore, the wearer is not required to turn to a mobile device, or some on-shoe interface to complete a task. System 100 allows the wearer to conveniently wake their smart shoe from a sleep state using low-power, foot-based gesture recognition system that detects close proximity of the companion shoe. Once awake, the shoe is capable if executing a command across a number of modes. As other sensors come online to detect commands from the wearer (e.g., voice, foot-based gestures).

Figure 9:
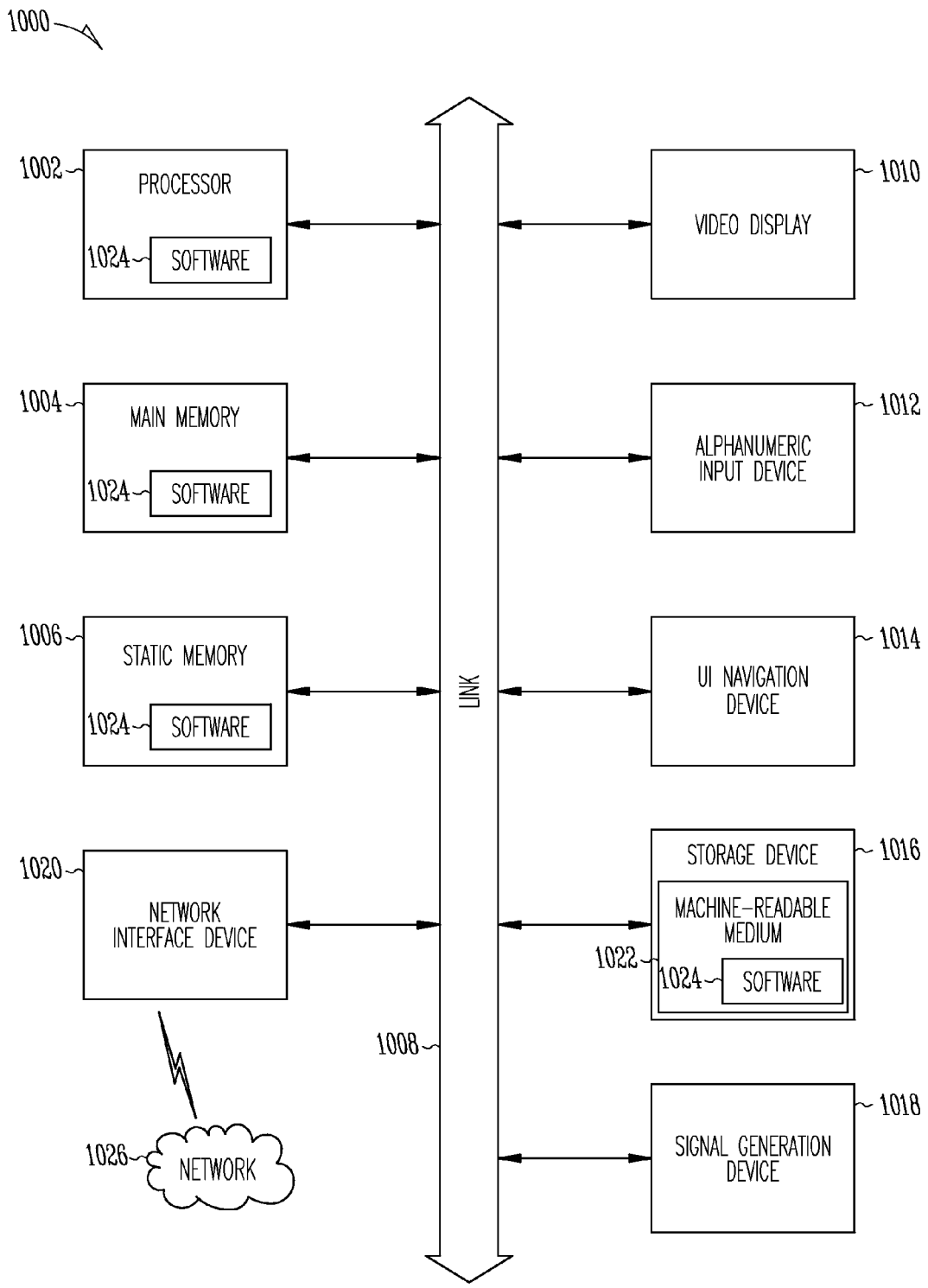
FIG. 9 is a block diagram illustrating an example machine upon which any one or more of the techniques (e.g., methodologies) discussed herein may perform, according to an example embodiment.

FIG. 9 is a block diagram illustrating a machine in the example form of a computer system 1000, within which a set or sequence of instructions may be executed to cause the machine to perform any one of the methodologies discussed herein, according to an example embodiment. In alternative embodiments, the machine operates as a standalone device or may be connected (e.g., networked) to other machines. In a networked deployment, the machine may operate in the capacity of either a server or a client machine in server-client network environments, or it may act as a peer machine in peer-to-peer (or distributed) network environments. The machine may be a personal computer (PC), a tablet PC, a hybrid tablet, a set-top box (STB), a personal digital assistant (PDA), a mobile telephone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein.

Example computer system 1000 includes at least one processor 1002 (e.g., a central processing unit (CPU), a graphics processing unit (GPU) or both, processor cores, compute nodes, etc.), a main memory 1004 and a static memory 1006, which communicate with each other via a link 1008 (e.g., bus). The computer system 102 may further include a video display unit 1010, an alphanumeric input device 1012 (e.g., a keyboard), and a user interface (UI) navigation device 1014 (e.g., a mouse). In one embodiment, the video display unit 1010, input device 1012 and UI navigation device 1014 are incorporated into a touch screen display. The computer system 102 may additionally include a storage device 1016 (e.g., a drive unit), a signal generation device 1018 (e.g., a speaker), a network interface device 1020, and one or more sensors (not shown), such as a global positioning system (GPS) sensor, compass, accelerometer, or other sensor.

The storage device 1016 includes a machine-readable medium 1022 on which is stored one or more sets of data structures and instructions 1024 (e.g., software) embodying or utilized by any one or more of the methodologies or functions described herein. The instructions 1024 may also reside, completely or at least partially, within the main memory 1004, static memory 1006, and/or within the processor 1002 during execution thereof by the computer system 102, with the main memory 1004, static memory 1006, and the processor 1002 also constituting machine-readable media.

While the machine-readable medium 1022 is illustrated in an example embodiment to be a single medium, the term "machine-readable medium" may include a single medium or multiple media (e.g., a centralized or distributed database, and/or associated caches and servers) that store the one or more instructions 1024. The term "machine-readable medium" shall also be taken to include any tangible medium that is capable of storing, encoding or carrying instructions for execution by the machine and that cause the machine to perform any one or more of the methodologies of the present disclosure or that is capable of storing, encoding or carrying data structures utilized by or associated with such instructions. The term "machine-readable medium" shall accordingly be taken to include, but not be limited to, solid-state memories, and optical and magnetic media. Specific examples of machine-readable media include non-volatile memory, including, but not limited to, by way of example, semiconductor memory devices (e.g., electrically programmable read-only memory (EPROM), electrically erasable programmable read-only memory (EEPROM)) and flash memory devices; magnetic disks such as internal hard disks and removable disks; magneto-optical disks; and CD-ROM and DVD-ROM disks.

The instructions 1024 may further be transmitted or received over a communications network 1026 using a transmission medium via the network interface device 1020 utilizing any one of a number of well-known transfer protocols (e.g., HTTP). Examples of communication networks include a local area network (LAN), a wide area network (WAN), the Internet, mobile telephone networks, plain old telephone (POTS) networks, and wireless data networks (e.g., Wi-Fi, 3G, and 4G LTE/LTE-A or WiMAX networks). The term "transmission medium" shall be taken to include any intangible medium that is capable of storing, encoding, or carrying instructions for execution by the machine, and includes digital or analog communications signals or other intangible medium to facilitate communication of such software.

ADDITIONAL NOTES & EXAMPLES

Example 1 includes a computing system having a processor, a network and a user interface communicatively coupled through the network to the processor, wherein the user interface includes a pair of wearable items, including a first and a second wearable item, wherein the first wearable item includes a command interface and a proximity detector, wherein the proximity detector detects when the pair of wearable items are in close proximity. The command interface is activated when the pair of wearable items are placed in close proximity. The command interface, when activated, receives commands and transfers the commands to the processor.

In Example 2, the computing system of Example 1 may optionally include an NFC device, the proximity detector detects when the pair of wearable items are in close proximity by detecting an NFC device in the second wearable item.

In Example 3, the computing system of any of Examples 1-2 may optionally include a camera, wherein the proximity detector detects when the pair of wearable items are in close proximity via the camera.

In Example 4, the computing system of any of Examples 1-3 may optionally include an infrared device, the proximity detector detects when the pair of wearable items are in close proximity by reflecting infrared light of the second wearable device and capturing the reflected infrared light via the camera.

In Example 5, the computing system of any of Examples 1-4 may optionally include wherein the pair of wearable devices is a pair of shoes, wherein one of the shoes includes a force detector that detects when the shoes are being worn.

In Example 6, the computing system of any of Examples 1-5 may optionally include wherein the command interface includes a nudge detector, wherein the nudge detector detects a nudge command via the force detector.

In Example 7, the computing system of any of Examples 1-6 may optionally include wherein the command interface receives commands from a sensor, wherein the sensor is selected from a group of sensors including a force detector, an accelerometer, a microphone and a touch sensor.

In Example 8, the computing system of any of Examples 1-6 may optionally include wherein the first wearable item includes an accelerometer connected to the command interface, wherein the command interface, when active, receives a gesture command via the accelerometer.

In Example 9, the computing system of any of Examples 1-6 may optionally include the first wearable item includes a microphone connected to the command interface, wherein the command interface, when active, receives a voice command via the microphone.

In Example 10, the computing system of any of Examples 1-6 may optionally include wherein the first wearable item includes a touch sensor connected to the command interface, wherein the command interface, when active, receives a touch command via the touch sensor.

In Example 11, the computing system of any of Examples 1-10 may optionally include wherein the wearable items are selected from the group of wearable items consisting of shoes, gloves, jewelry, watches, wrist bands and head bands.

In Example 12, the computing system of any of Examples 1-11 may optionally include wherein the first wearable item includes an item processor, wherein the item processor includes a lowest power sleep mode and an awake and listening mode, wherein the command interface moves the processor from the lowest power sleep mode to the awake and listening mode on detecting that the pair of wearable items are in close proximity.

Example 13 includes subject matter (such as a device, apparatus, or machine) for detecting that a pair of wearable items are in close proximity, activating a command interface connected to the a processor on detecting that the pair of wearable items are in close proximity, receiving a command via the command interface and transferring the command to the processor.

In Example 14, the subject matter of Example 13 may optionally include wherein detecting that a pair of wearable items are in close proximity includes detecting an NFC device in the second wearable item.

In Example 15, the subject matter of any of Examples 13-14 may optionally include wherein detecting that a pair of wearable items are in close proximity includes capturing an image via a camera embedded in one of the wearable items.

In Example 16, the subject matter of any of Examples 13-15 may optionally include wherein capturing an image includes reflecting infrared light off one of the wearable items and receiving the reflected infrared light at the camera.

In Example 17, the subject matter of any of Examples 13-16 may optionally include wherein one of the wearable items is a shoe with a force detector, wherein detecting that the wearable items are in close proximity includes detecting, via the force detector, that the shoe is being worn.

In Example 18, the subject matter of any of Examples 13-17 may optionally include wherein the command interface includes a nudge detector, wherein receiving a command includes receiving a nudge command via the force detector.

In Example 19, the subject matter of any of Examples 13-18 may optionally include wherein receiving a command includes receiving a signal from a sensor.

In Example 20, the subject matter of any of Examples 13-19 may optionally include wherein the command interface includes an accelerometer connected to the command interface, wherein receiving a command includes receiving a gesture command via the accelerometer.

In Example 21, the subject matter of any of Examples 13-20 may optionally include wherein the command interface includes a microphone connected to the command interface, wherein receiving a command includes receiving a voice command via the microphone.

In Example 22, the subject matter of any of Examples 13-21 may optionally include wherein the command interface includes a touch sensor connected to the command interface, wherein receiving a command includes receiving a touch command via the touch sensor.

In Example 23, the subject matter of any of Examples 13-22 may optionally include wherein detecting that a pair of wearable items are in close proximity includes selecting each wearable item from the group of wearable items consisting of shoes, gloves, jewelry, watches, wrist bands and head bands.

In Example 24, the subject matter of any of Examples 13-23 may optionally include wherein one of the wearable items includes a processor and wherein activating the command interface includes awakening the wearable item processor, wherein awakening the wearable item processor includes moving the wearable item processor from a lowest power sleep mode to an awake and listening mode.

In Example 25, the subject matter of any of Examples 13-24 may optionally include a machine readable storage medium including program code which, when executed, causes a machine to perform the example method.

In Example 26, the subject matter of any of Examples 13-24 may optionally include means for performing the method of the example.

Example 27 includes a wearable item including means for wearing the wearable item, means for communicating with a processor, means for detecting that the wearable item is in close proximity to another wearable item, means for activating a command interface connected to the processor on detecting that the wearable item is in close proximity to another wearable item, means for receiving a command via the command interface and means for transferring the command to the processor.

In Example 28, the wearable item of Example 27 may optionally include wherein the means for detecting that the wearable item is in close proximity to another wearable item includes means for detecting an NFC device in the other wearable item.

In Example 29, the wearable item of any one of Examples 27-28 may optionally include wherein the means for detecting that the device is in close proximity to another wearable item includes means for capturing an image via a camera embedded in one of the wearable items.

In Example 30, the wearable item of any one of Examples 27-29 may optionally include wherein the means for capturing an image includes means for reflecting infrared light off one of the wearable items and means for receiving the reflected infrared light at the camera.

In Example 31, the wearable item of any one of Examples 27-30 may optionally include wherein one of the wearable items is a shoe with a force detector, wherein the means for detecting that the wearable items are in close proximity includes means for detecting, via the force detector, that the shoe is being worn.

In Example 32, the wearable item of any one of Examples 27-31 may optionally include wherein the command interface includes a nudge detector, wherein the means for receiving a command includes means for receiving a nudge command via the force detector.

In Example 33, the wearable item of any one of Examples 27-32 may optionally include the means for receiving a command includes means for receiving a signal from a sensor.

In Example 34, the wearable item of any one of Examples 27-33 may optionally include wherein the command interface includes an accelerometer connected to the command interface, wherein the means for receiving a command includes means for receiving a gesture command via the accelerometer.

In Example 35, the wearable item of any one of Examples 27-34 may optionally include wherein the command interface includes a microphone connected to the command interface, wherein the means for receiving a command includes means for receiving a voice command via the microphone.

In Example 36, the wearable item of any one of Examples 27-35 may optionally include wherein the command interface includes a touch sensor connected to the command interface, wherein the means for receiving a command includes means for receiving a touch command via the touch sensor.

In Example 37, the wearable item of any one of Examples 27-36 may optionally include wherein the wearable item takes the form of an item from the group of wearable items consisting of shoes, gloves, jewelry, watches, wrist bands and head bands.

In Example 38, the wearable item of any one of Examples 27-37 may optionally include wherein the means for detecting includes an item processor, wherein the means for activating the command interface includes means for awakening the item processor, wherein the means for awakening the item processor includes means for moving the item processor from a lowest power sleep mode to an awake and listening mode.

In Example 39, the wearable item of any one of Examples 27-38 may optionally include wherein the means for detecting and the command interface are encased in a module designed to fit in a void formed in a shoe.

Example 40 includes a system having a pair of wearable items, including a first and a second wearable item, wherein the first wearable item includes a command interface and proximity detecting means for detecting when the pair of wearable items are in close proximity, wherein the command interface is activated when the pair of wearable items are placed in close proximity and wherein the command interface, when activated, receives commands and transfers the commands to a processor.

In Example 41, the system of Example 40 may optionally include wherein the proximity detecting means and the command interface are encased in a package designed to fit in a void formed in a shoe.

In Example 42, the system of any one of Examples 40-41 may optionally include wherein the proximity detecting means is selected from a group consisting of a force detector, an accelerometer, a microphone and a touch sensor. In Example 3, the system of any one of Examples 40-42 may optionally include wherein the pair of wearable items is a pair of shoes, wherein one of the shoes includes a force detector, wherein detecting that the pair of shoes are in close proximity includes detecting, via the force detector, that the shoes are being worn and wherein receiving a command includes receiving a command via at least one of a group consisting of the force detector, an accelerometer, a microphone and a touch sensor.

The above detailed description includes references to the accompanying drawings, which form a part of the detailed description. The drawings show, by way of illustration, specific embodiments that may be practiced. These embodiments are also referred to herein as "examples." Such examples may include elements in addition to those shown or described. However, also contemplated are examples that include the elements shown or described. Moreover, also contemplate are examples using any combination or permutation of those elements shown or described (or one or more aspects thereof), either with respect to a particular example (or one or more aspects thereof), or with respect to other examples (or one or more aspects thereof) shown or described herein.

Publications, patents, and patent documents referred to in this document are incorporated by reference herein in their entirety, as though individually incorporated by reference. In the event of inconsistent usages between this document and those documents so incorporated by reference, the usage in the incorporated reference(s) are supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to suggest a numerical order for their objects.

The above description is intended to be illustrative, and not restrictive. For example, the above-described examples (or one or more aspects thereof) may be used in combination with others. Other embodiments may be used, such as by one of ordinary skill in the art upon reviewing the above description. The Abstract is to allow the reader to quickly ascertain the nature of the technical disclosure, for example, to comply with 37 C.F.R. §1.72(b) in the United States of America. It is submitted with the understanding that it will not be used to interpret or limit the scope or meaning of the claims. Also, in the above Detailed Description, various features may be grouped together to streamline the disclosure. However, the claims may not set forth every feature disclosed herein as embodiments may feature a subset of said features. Further, embodiments may include fewer features than those disclosed in a particular example. Thus, the following claims are hereby incorporated into the Detailed Description, with a claim standing on its own as a separate embodiment. The scope of the embodiments disclosed herein is to be determined with reference to the appended claims, along with the full scope of equivalents to which such claims are entitled.

The invention claimed is:

1. A method of initiating a command in a computing system having a processor, the method comprising:

detecting activity at a first wearable item or a second wearable item of a pair of wearable items;

changing a power mode of the processor from a lowest power sleep mode to a low power sleep mode, the low power sleep mode activating proximity detection in the pair of wearable items that was deactivated in the lowest power sleep mode;

detecting that the pair of wearable items are in close proximity;

activating a command interface connected to the processor in response to detecting that the pair of wearable items are in close proximity, wherein activating the command interface includes awakening the processor by changing the power mode of the processor from the low power mode to an awake and listening power mode, the awake and listening power mode activating gesture detection in the pair of wearable items that was deactivated in the low power sleep mode;

identifying a plurality of gestures performed within a predetermined period of time by the pair of wearable items, wherein a first gesture of the plurality of gestures is performed using a first wearable item of the pair of wearable items and a second gesture of the plurality of gestures is performed using a second wearable item of the pair of wearable items;

determining a gesture-based command from the plurality of gestures via the command interface; and providing feedback in response to the gesture-based command.

2. The method of claim 1, wherein detecting that the pair of wearable items are in close proximity includes detecting a Near Field Communication (NFC) device in the second wearable item.

3. The method of claim 1, wherein one of the pair of wearable items is a shoe with a force detector, wherein detecting that the pair of wearable items are in close proximity includes detecting, via the force detector, that the shoe is being worn.

4. The method of claim 3, wherein the command interface includes a nudge detector, wherein determining the gesture-based command includes receiving a nudge command via the force detector.

5. The method of claim 1, wherein determining the gesture-based command includes receiving a signal from a sensor.

6. The method of claim 1, wherein detecting that the pair of wearable items are in close proximity includes selecting the pair of wearable items from a group of wearable items consisting of shoes, gloves, jewelry, watches, wrist bands and head bands.

7. A system, comprising:

a pair of wearable items, including a first and a second wearable item, wherein the first wearable item includes a command interface and proximity detecting circuitry for detecting when the pair of wearable items are in close proximity; wherein the command interface is:

in a lowest power sleep mode until activity is detected at one of the first or the second wearable item, wherein the proximity detecting circuitry is deactivated in the lowest power sleep mode;

in a low power sleep mode after activity is detected, wherein the proximity detecting circuitry is activated and a gesture detection sensor is deactivated in the low power sleep mode; and in an awake and listening power mode and activated when the pair of wearable items are placed in close proximity, wherein the gesture detection sensor is activated in the awake and listening power mode;

wherein the command interface, when activated is configured to:

identify a plurality of gestures performed within a predetermined period of time by the pair of wearable items, wherein a first gesture of the plurality of gestures is performed using the first wearable item and a second gesture of the plurality of gestures is performed using the second wearable item;

determine a gesture-based command from the plurality of gestures; and provide feedback in response to the gesture-based command.

8. The system of claim 7, wherein the proximity detecting circuitry and the command interface are encased in a package designed to fit in a void formed in a shoe.

9. The system of claim 7, wherein the proximity detecting circuitry is selected from a group consisting of a force detector, an accelerometer, a microphone and a touch sensor.

10. The system of claim 7, wherein the first and the second wearable items are a pair of shoes, wherein one of the pair of shoes includes a force detector that detects when the pair of shoes are being worn.

11. The system claim of 7, wherein the command interface is further configured to:

receive sensor data via the gesture detection sensor, the gesture detection sensor including at least one of a force detector, an accelerometer, a microphone and a touch sensor.

12. The system of claim 7, wherein the proximity detecting circuitry includes a Near Field Communication (NFC) device and wherein the proximity detecting circuitry detects when the pair of wearable items are in close proximity by detecting an NFC device in the second wearable item.

13. The system of claim 7, wherein the proximity detecting circuitry includes a camera and wherein the proximity detecting circuitry detects when the first and the second wearable items arc in close proximity via the camera.

14. The system of claim 7, wherein the proximity detecting circuitry includes an infrared device and wherein the proximity detecting circuitry detects when the first and the second wearable items are in close proximity by reflecting infrared light off the second wearable item and capturing the reflected infrared light via the infrared device.

15. A non-transitory machine readable medium including instructions, which when executed by a processor, cause the processor to:

detect activity at a first wearable item or a second wearable item of a pair of wearable items;

change a power mode of the processor from a lowest power sleep mode to a low power sleep mode, the low power sleep mode activating proximity detection in the pair of wearable items that was deactivated in the lowest power sleep mode;

detect that the pair of wearable items are in close proximity;

activate a command interface connected to the processor in response to detecting that the pair of wearable items are in close proximity, wherein to activating the command interface includes awakening the processor by changing the power mode of the processor from the low power mode to an awake and listening power mode, the awake and listening power mode activating gesture detection in the pair of wearable items that was deactivated in the low power sleep mode;

identify a plurality of gestures performed within a predetermined period of time by the pair of wearable items, wherein a first gesture of the plurality of gestures is performed using a first wearable item of the pair of wearable items and a second gesture of the plurality of gestures is performed using a second wearable item of the pair of wearable items;

determine a gesture-based command from the plurality of gestures via the command interface; and provide feedback in response to the gesture-based command.

16. The non-transitory machine readable medium of claim 15, wherein the instructions to detect that the pair of wearable items are in close proximity include instructions to detect a Near Field Communication (NFC) device in the second wearable item from the pair of wearable items.

17. The non-transitory machine readable medium of claim 15, wherein one of the pair of wearable items is a shoe with a force detector, wherein the instructions to detect that the pair of wearable items are in close proximity include instructions to detect, via the force detector, that the shoe is being worn.

18. The non-transitory machine readable medium of claim 15, wherein the command interface includes a nudge detector, wherein the instructions to determine the gesture-based command include instructions to receive a nudge command via the force detector.

19. The non-transitory machine readable medium of claim 15, wherein the instructions to identify a plurality of gestures include instructions to receive a signal from a sensor.

20. The non-transitory machine readable medium of claim 15, wherein the instructions to detect that the pair of wearable items are in close proximity include instructions to select the pair of wearable items from a group of wearable items consisting of shoes, gloves, jewelry, watches, wrist bands and head bands.

* * * * *